US011428486B2

(12) United States Patent
McDonald

(10) Patent No.: US 11,428,486 B2
(45) Date of Patent: Aug. 30, 2022

(54) COMPACT FIREARM

(71) Applicant: Michael Ray McDonald, Lancaster, KY (US)

(72) Inventor: Michael Ray McDonald, Lancaster, KY (US)

( * ) Notice: Subject to any disclaimer, the term of this patent is extended or adjusted under 35 U.S.C. 154(b) by 0 days.

(21) Appl. No.: 17/372,243

(22) Filed: Jul. 9, 2021

(65) Prior Publication Data

US 2022/0011066 A1 Jan. 13, 2022

Related U.S. Application Data

(60) Provisional application No. 63/050,764, filed on Jul. 11, 2020, provisional application No. 63/117,140, filed on Nov. 23, 2020.

(51) Int. Cl.

| | |
|---|---|
| ***F41A 11/04*** | (2006.01) |
| ***F41A 9/46*** | (2006.01) |
| ***F41A 19/12*** | (2006.01) |
| ***F41A 19/13*** | (2006.01) |
| ***F41A 19/10*** | (2006.01) |
| ***F41C 9/02*** | (2006.01) |

(52) U.S. Cl.

CPC ..... *F41A 11/04* (2013.01); *F41A 9/46* (2013.01); *F41A 19/10* (2013.01); *F41A 19/12* (2013.01); *F41A 19/13* (2013.01); *F41C 9/02* (2013.01)

(58) Field of Classification Search

CPC .. F41A 9/46; F41A 11/04; F41A 19/10; F41A 19/12; F41A 19/13; F41C 9/02

USPC .... 42/8, 9, 12, 13, 14, 26, 69.01; 89/22, 25, 89/27.11, 27.13, 27.14

See application file for complete search history.

(56) References Cited

U.S. PATENT DOCUMENTS

| | | | | | |
|---|---|---|---|---|---|
| 1,109,383 | A * | 9/1914 | White | F41C 9/02 | 42/8 |
| 2,423,448 | A * | 7/1947 | Haight | F41C 9/02 | 2/160 |
| 3,018,578 | A * | 1/1962 | Hill | F41C 9/02 | 42/13 |
| 3,707,793 | A * | 1/1973 | Holton, II | F41C 9/02 | 42/1.15 |

(Continued)

FOREIGN PATENT DOCUMENTS

| | | | | |
|---|---|---|---|---|
| WO | WO-8701261 A * | 3/1987 | A22B 3/02 |
| WO | WO-9915850 A2 * | 4/1999 | F41A 11/04 |

*Primary Examiner* — Bret Hayes

(74) *Attorney, Agent, or Firm* — Bennet K. Langlotz; Langlotz Patent & Trademark Works, LLC

(57) ABSTRACT

A compact firearm has a frame including a barrel defining a chamber, the frame being movable between a closed condition in which the firearm is operable to discharge a cartridge in the chamber, and an open condition in which the chamber is open for loading, a latch movable between a latched condition to retain the frame in the closed condition, and an unlatched condition to enable movement of the frame to the open condition, a firing mechanism connected to the frame and operable in response to actuation to discharge the cartridge in the chamber, and a trigger element operably connected to the firing mechanism to selectably actuate the firing mechanism, and operably connected to the latch to move the latch to the unlatched condition. The trigger element may be operable to selectably actuate the firing mechanism in response to movement in a first direction.

18 Claims, 13 Drawing Sheets

(56) References Cited

U.S. PATENT DOCUMENTS

| | | | | |
|---|---|---|---|---|
| 5,791,327 | A * | 8/1998 | Riggs | F41A 19/18 124/71 |
| 10,113,822 | B1 * | 10/2018 | Hobush | F41A 19/13 |
| 10,126,079 | B2 | 11/2018 | Voigt | |
| 2006/0048426 | A1 * | 3/2006 | Crandall | F41A 19/12 42/69.01 |
| 2017/0045329 | A1 * | 2/2017 | Turnington | F41C 9/02 |
| 2017/0131052 | A1 | 5/2017 | Voigt | |
| 2018/0135931 | A1 * | 5/2018 | Cano | F41A 19/14 |
| 2019/0033027 | A1 | 1/2019 | Voigt | |

* cited by examiner

COMPACT FIREARM

CROSS-REFERENCE TO RELATED APPLICATION

This application claims the benefit of U.S. Provisional Patent Application No. 63/050,764 filed on Jul. 11, 2020, entitled "Ultra-Compact Firearm," and also claims the benefit of U.S. Provisional Patent Application No. 63/117,140 filed on Nov. 23, 2020, entitled "ULTRA-COMPACT FIREARM," which are hereby incorporated by reference in their entirety for all that is taught and disclosed therein.

FIELD OF THE INVENTION

The present invention relates to firearms, and more particularly to a compact firearm that minimizes size and weight to enhance concealability and carrying comfort.

BACKGROUND AND SUMMARY OF THE INVENTION

Concealed carry is the practice of carrying a firearm, usually a handgun, in public in a concealed manner. Typical concealed carry locations include pants and coat pockets, purses, and bags. Challenges posed by size, weight, and concealability make many firearms unsuitable for concealed carry. Although the handgun industry has made some efforts to improve the size, weight, and concealability of firearms, most manufacturers still employ traditional handgun designs, which require undesirable tradeoffs when the designs are miniaturized.

Traditional handgun designs include a handle that is nearly perpendicular to the barrel axis with an index finger trigger mechanism. When this traditional handgun design is miniaturized for size, weight, and concealability improvement, the handle usually becomes smaller, making it difficult to secure with all fingers. In many designs, only two or three fingers can be wrapped around the handle, thereby reducing the controllability of the firearm. Furthermore, a traditional handgun shape can be difficult to draw smoothly from a pocket and often turns pockets inside out, which causes snagging when the firearm is drawn. In addition, miniaturized traditional handgun designs still have an easily identifiable shape when carried in a pocket, which makes them less concealed.

Other problems that come with miniaturizing traditional handgun designs are increased target acquisition time, reduced ease of sight picture, and reduced sighting accuracy/precision. Most traditional handgun designs, miniaturized or not, require the firearm to be raised so the sighting devices are in somewhat of an alignment with the shooter's eye line of sight. This eye alignment process inherently takes extra time and reduces the shooter's overall field of view.

Handgun miniaturization also usually results in a reduced sight radius (the distance between the front and rear sights), which is a detriment to shooter accuracy and precision. There are some sighting devices, like lasers, that do not require raising the firearm to eye level, but most of these designs require a separate action to turn the laser device on, which also takes time.

Therefore, a need exists for a new and improved compact firearm that minimizes size and weight to enhance concealability and carrying comfort. In this regard, the various embodiments of the present invention substantially fulfill at least some of these needs. In this respect, the compact firearm according to the present invention substantially departs from the conventional concepts and designs of the prior art, and in doing so provides an apparatus primarily developed for the purpose of minimizing size and weight to enhance concealability and carrying comfort.

The present invention provides an improved compact firearm, and overcomes the above-mentioned disadvantages and drawbacks of the prior art. As such, the general purpose of the present invention, which will be described subsequently in greater detail, is to provide an improved compact firearm that has all the advantages of the prior art mentioned above.

To attain this, the preferred embodiment of the present invention essentially comprises a frame including a barrel defining a chamber, the frame being movable between a closed condition in which the firearm is operable to discharge a cartridge in the chamber, and an open condition in which the chamber is open for loading, a latch movable between a latched condition to retain the frame in the closed condition, and an unlatched condition to enable movement of the frame to the open condition, a firing mechanism connected to the frame and operable in response to actuation to discharge the cartridge in the chamber, and a trigger element operably connected to the firing mechanism to selectably actuate the firing mechanism, and operably connected to the latch to move the latch to the unlatched condition. The trigger element may be operable to selectably actuate the firing mechanism in response to movement in a first direction. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
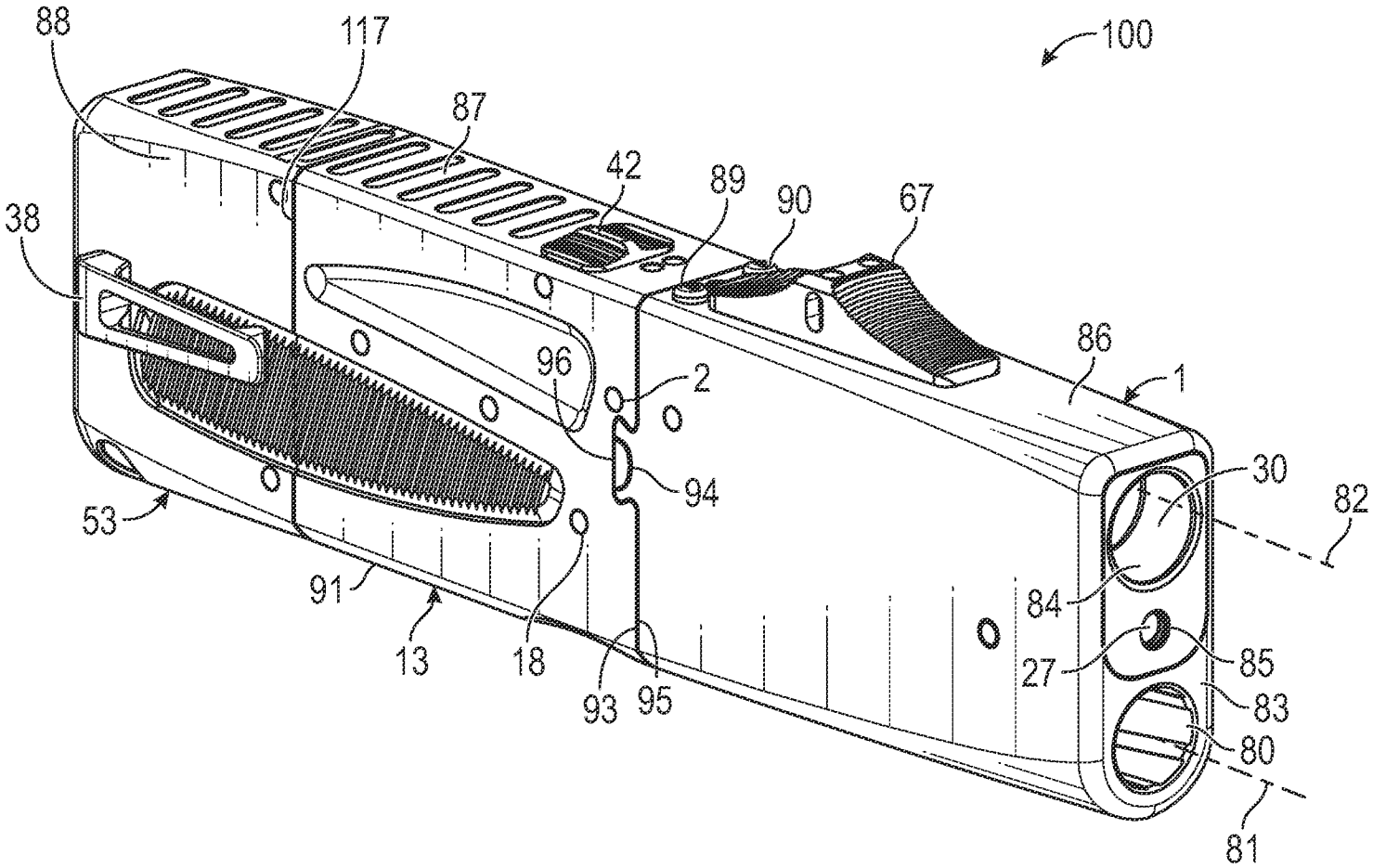
FIG. 1 is a top right isometric view of the right side of the current embodiment of a compact firearm constructed in accordance with the principles of the present invention in the closed position.

An embodiment of the compact firearm of the present invention is shown and generally designated by the reference numeral 100.

Figure 2:
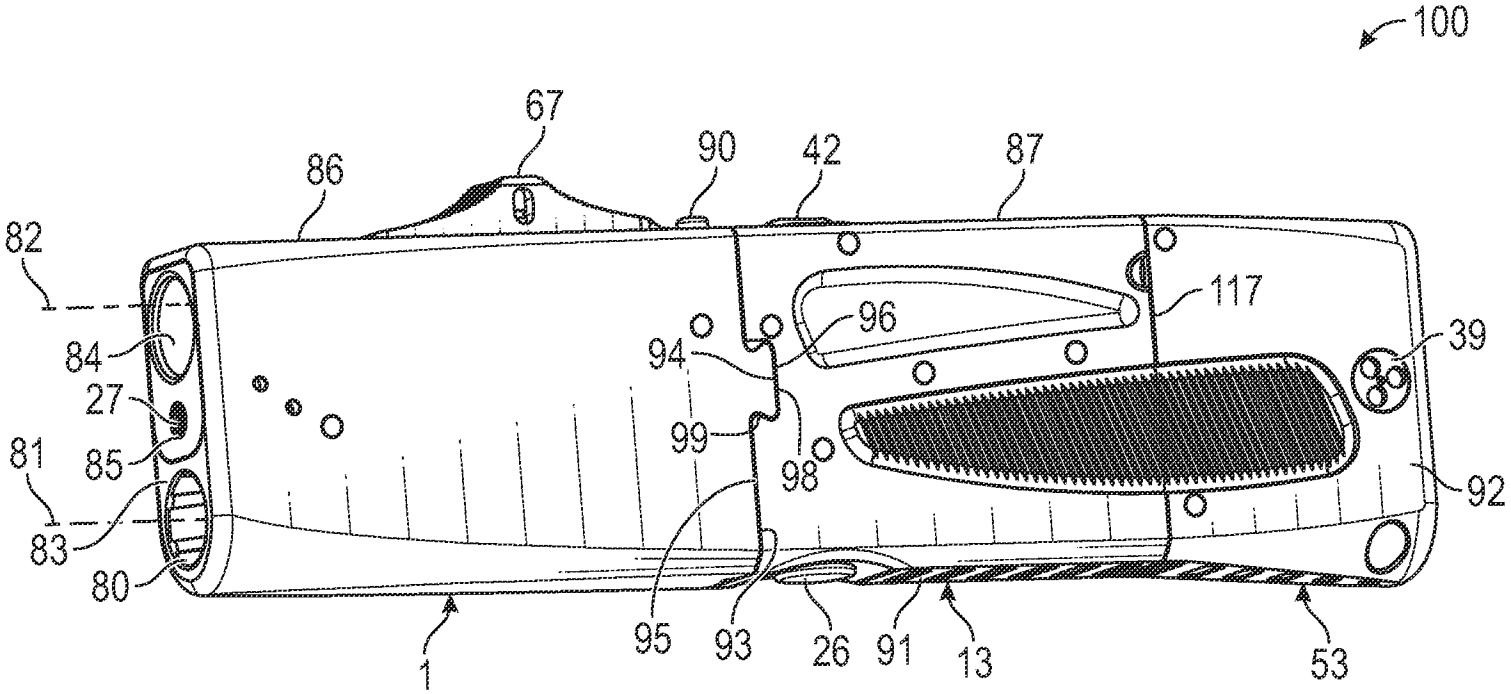
FIG. 2 is a bottom left isometric view of the left side of the compact firearm of FIG. 1 in the closed position.
Figure 3:
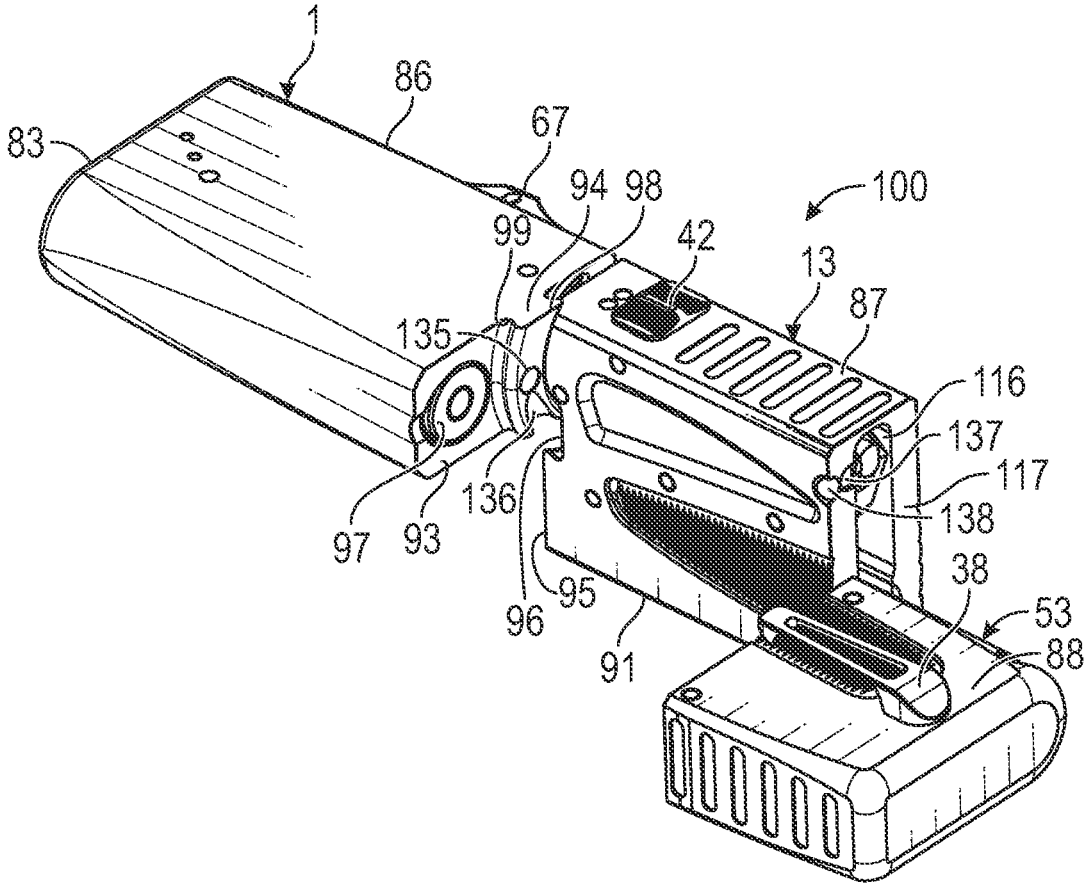
FIG. 3 is a top right isometric view of the left side of the compact firearm of FIG. 1 in the open position.

FIGS. 1-3 illustrate the improved compact firearm 100 of the present invention. More particularly, FIGS. 1 & 2 show the compact firearm in the closed position operable for discharge, and FIG. 3 shows the compact firearm in the open position in which a barrel chamber 97 is accessible for loading. The compact firearm is an elongated rectangular body when in the closed position. The compact firearm has a barrel housing 1, which is a first frame portion including a barrel 80 defining a barrel axis 81. The barrel can be configured as a rifled or smooth bore and can be chambered in a wide range of calibers, including 9 mm, 10 mm, and 0.22. The compact firearm has a drive housing 13, which is a second frame portion including a firing mechanism 101 (shown in FIG. 5) that is pivotally connected to the barrel housing to pivot about a pivot axis 82 offset from and parallel to the barrel axis. The drive housing serves as the action of the compact firearm and is marked with the compact firearm's serial number. The compact firearm also has a stock 53, which is a third frame portion rotatable relative to the drive housing. The stock serves as a housing for additional ammunition and has some grip surfaces that are at an angle to the barrel axis 81 and extend below the barrel axis.

The barrel housing 1 has a front that defines an aperture 84 for an LED 30 (light emitting device) and an aperture 85 for a laser 27. The barrel housing 1 has a top 86 that receives a trigger element 67. The top of the barrel housing also includes a flashlight button 89 that turns the LED on-and-off and a laser button 90 that turns the laser on-and-off without requiring the user to touch the trigger element 67 first. When shooting, the compact firearm 100 does not need to be held at eye level because of the laser sight, which can reduce target acquisition time. The drive housing 13 has a top 87 that receives a primary safety switch 42 and a bottom 91 that receives a grip drop safety switch 26. The stock 53 has a right side 88. A pocket clip 38 is attached to the right side of the stock by a pocket clip fastener 39 received by the left side 92 of the stock. The pocket clip 38 and pocket clip fastener 39 can be reverse mounted such that the pocket clip fastener 39 is attached to the right side 88 of the stock and the pocket clip is attached to the left side 92 of the stock. This pocket clip reversibility provides ambidextrous conveniences for carrying and user comfort.

Figure 4:
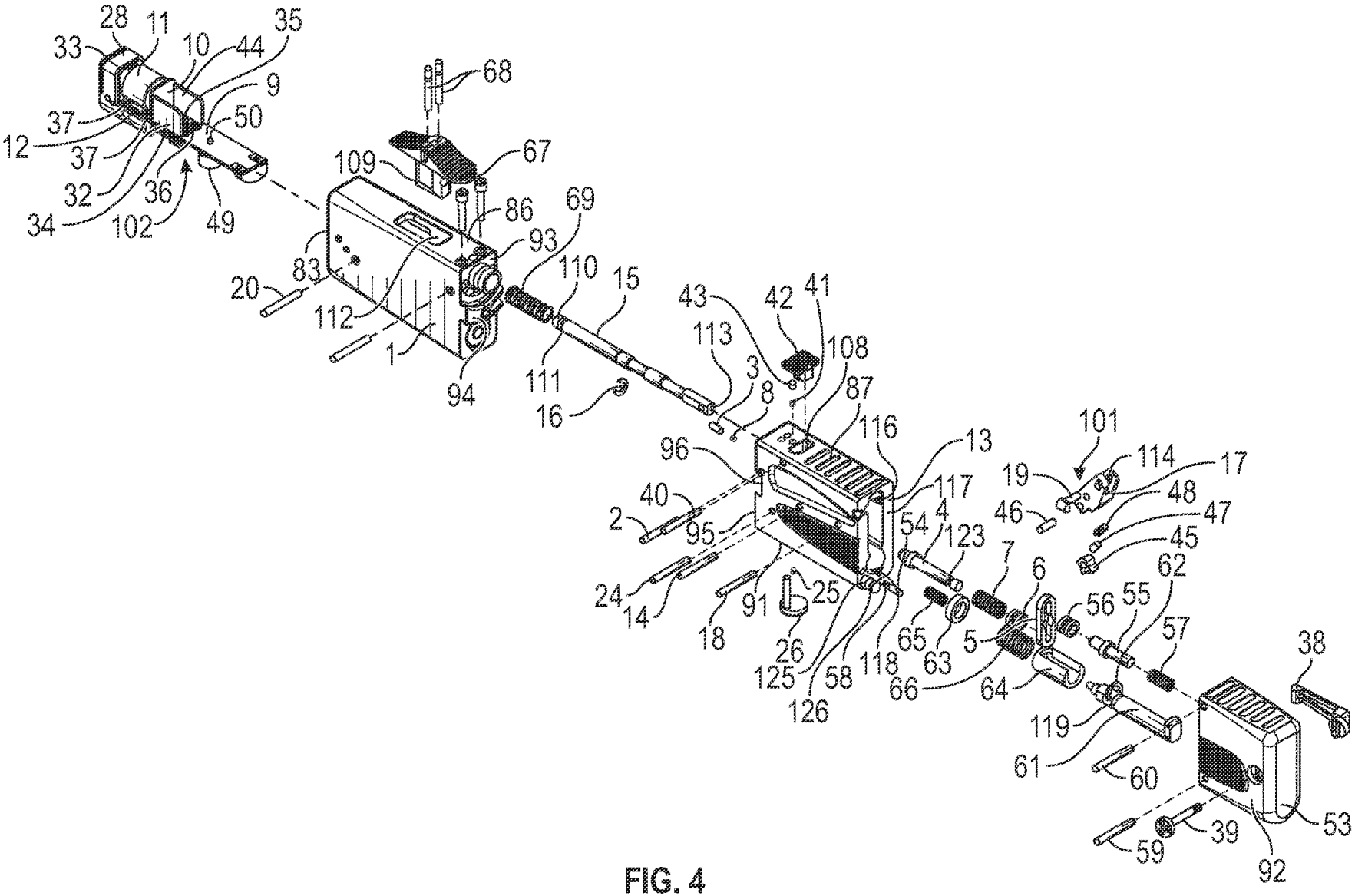
FIG. 4 is an exploded view of the compact firearm of FIG. 1.
Figure 9:
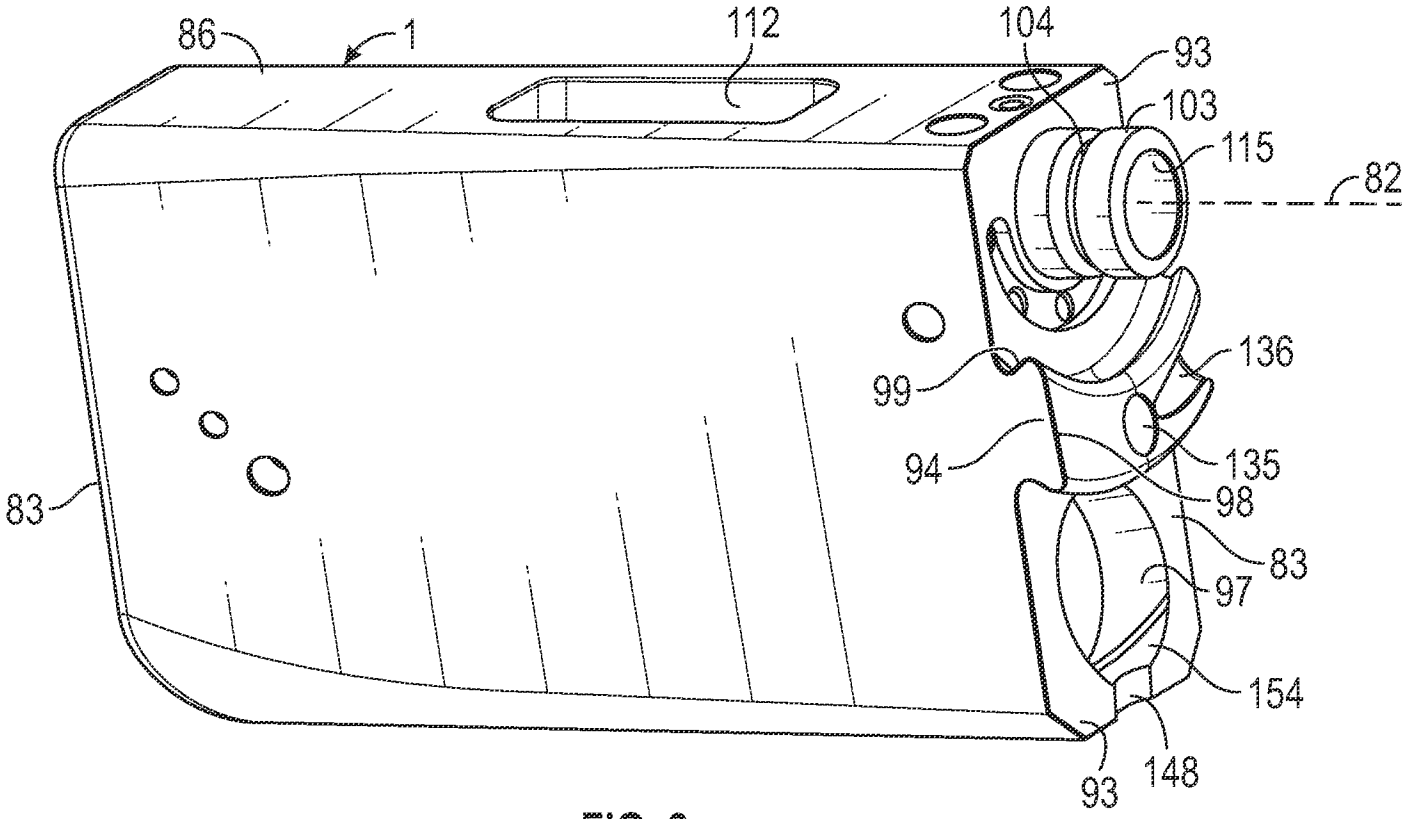
FIG. 9 is a top right isometric view of the left side of the barrel housing of the compact firearm. of FIG. 1.
Figure 10:
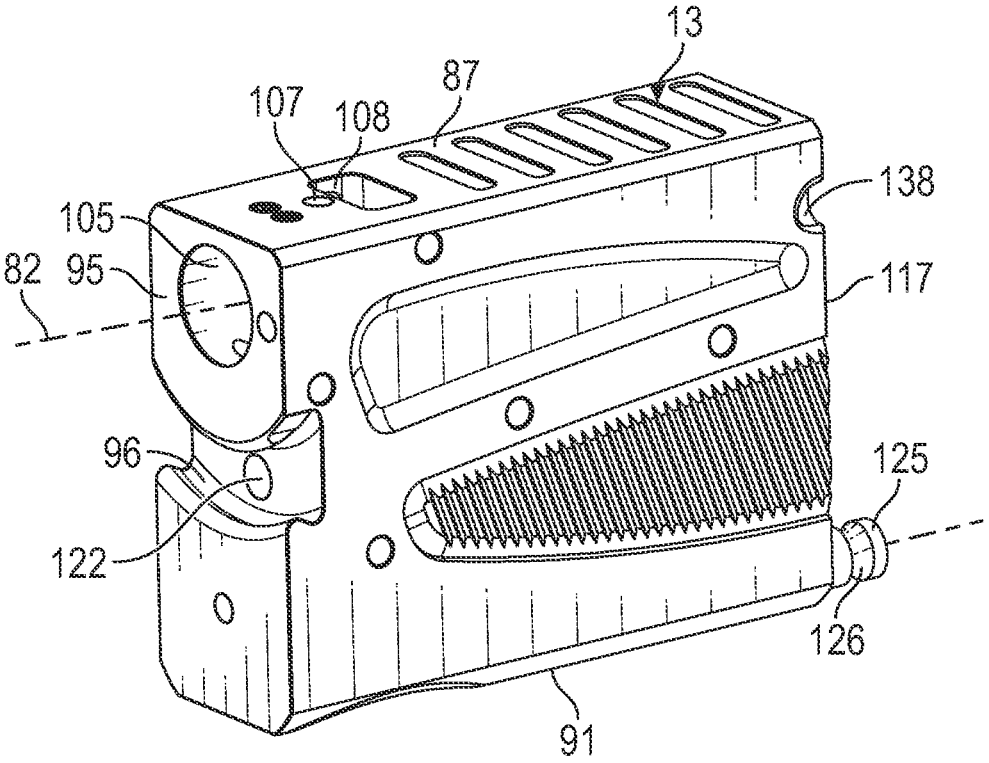
FIG. 10 is a top left isometric view of the left side of the drive housing of the compact firearm of FIG. 1.

As can be best appreciated in FIGS. 3, 4, and 9, barrel housing 1 has a rear 93 exposing the barrel chamber 97 and defining a first mating feature 94 formed as a first surface of revolution about the pivot axis 82. The drive housing 13 has a front 95 defining a second mating feature 96 formed as a second surface of revolution about the pivot axis. The first and second mating features mate closely with each other to minimize movement between the barrel housing and the drive housing except in relative rotation about the pivot axis. In the current embodiment, the first and second mating features are captive, arcuate dovetail-like elements. The rear of the barrel housing and the front of the drive housing are abutting end faces facing each other that are perpendicular to the pivot axis. The first mating feature is a male element protruding from the rear of the barrel housing above the end face. The second mating feature is a female element recessed from the front of the drive housing below the end face. The second mating feature's profile cross-section is adapted to closely receive the first mating feature's profile cross-section. The profile cross-sections may be constant, or the profile cross-sections may contain holes, ramps, and small notches. The cross-section of the first mating feature has a head portion 98 with a first width and a neck portion 99 of a lesser second width. The rear of the barrel housing also defines a male cylindrical pivot protrusion 103 having a circumferential groove 104 that is received in a female pivot aperture 105 defined by the front of the drive housing.

FIG. 4 illustrates the improved compact firearm 100 of the present invention. More particularly, the compact firearm has a barrel housing 1, barrel connection base pin 2, barrel detent pin 3, barrel lock pin 4, barrel lock pin connector 5, barrel lock pin retainer bushing 6, barrel lock pin spring 7, barrel open detent spring 8, base PCB mount 9, battery spring terminal PCB mount 10, battery 11, battery retainer PCB mounts 12, drive housing 13, drive retainer bushing base pin 14, drive rod 15, drive rod C-ring 16, drive rod connector 17, drive rod connector base pin 18, drive rod connector pin 19, electronic module base pin 20, elevation adjustor 21 (shown in FIGS. 6-8), elevation spring 22 (shown in FIGS. 6-8), elevation spring set screw 23 (shown in FIGS. 6-8), grip drop safety base pin 24, grip drop safety spring 25, grip drop safety switch 26, laser 27 (shown in FIGS. 6-8), laser light housing 28, laser retaining pin 29 (shown in FIGS. 6-8), LED 30 (shown in FIGS. 6-8), LED PCB mount 31 (shown in FIGS. 6-8), left auxiliary PCB mount 32, light lens 33 (shown in FIGS. 6-8), microcontroller 34, momentary switch 35, momentary switch spacer PCB mount 36, PCB mount screw 37, pocket clip 38, pocket clip fastener 39, primary safety base pin 40, primary safety spring 41, primary safety switch 42, primary safety switch pin 43, right auxiliary PCB mount 44, sear 45, sear connector pin 46, sear reset pin 47, sear reset spring 48, solenoid 49, solenoid rod 50, solid battery terminal 51, spring battery terminal 52, stock 53, stock detent pin 54, stock lock pin 55, stock lock pin retainer bushing 56, stock lock pin spring 57, stock open detent spring 58, stock pivot base pin 59, stock retainer bushing base pin 60, striker 61, striker C-ring 62, striker front bushing 63, striker rear bushing 64, striker return spring 65, striker spring 66, trigger element 67, trigger pins 68, trigger return spring 69, windage adjuster 70, windage spring 71, windage spring set screw 72 (visible in FIGS. 6-8), light button 73, laser button 74, laser light button retaining pin 75, light momentary switch 76, laser momentary switch 77, and PCB support 78.

Figure 5:
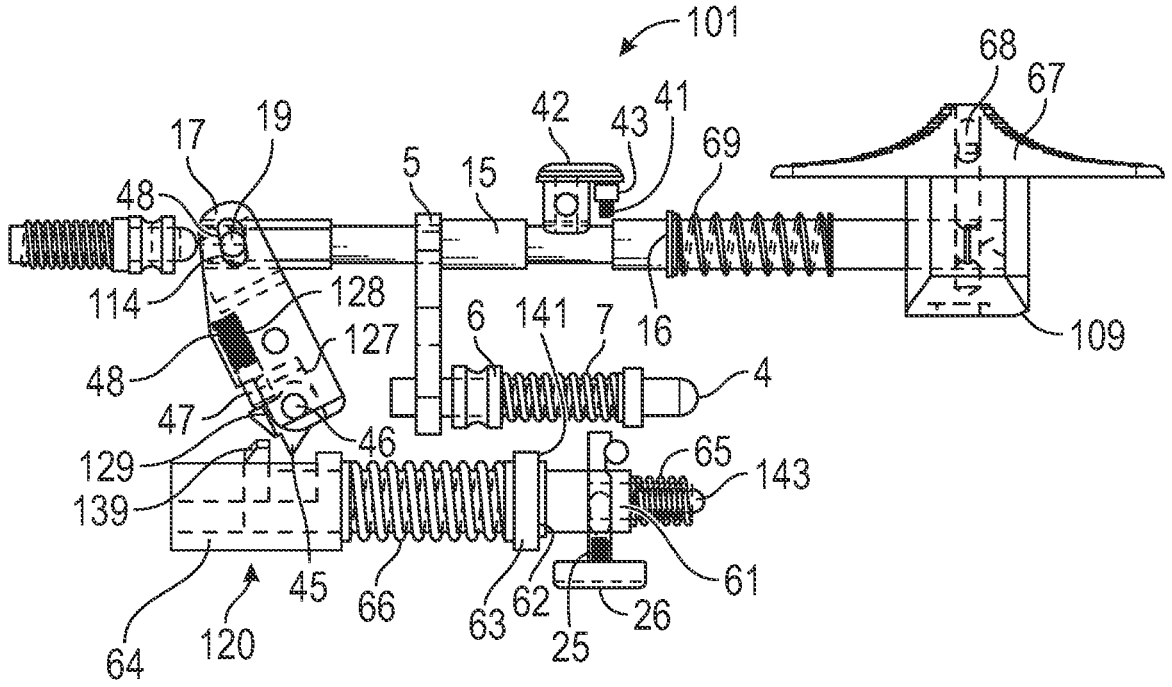
FIG. 5 is a side view of the firing and opening mechanisms of the compact firearm of FIG. 1.

FIG. 5 illustrates the improved firing mechanism of the compact firearm 100 of the present invention. The firing mechanism 101 is formed by the barrel lock pin 4, the barrel lock pin connector 5, the barrel lock pin retainer bushing 6, the barrel lock pin spring 7, the drive rod 15, the drive rod C-ring 16, the drive rod connector 17, the drive rod connector pin 19, the sear 45, the sear connector pin 46, the sear reset pin 47, the sear reset spring 48, the striker 61, the striker C-ring 62, the striker front bushing 63, the striker rear bushing 64, the striker return spring 65, the striker spring 66, the trigger element 67, the trigger pins 68, and the trigger return spring 69.

An electronic module 102 is formed by the base PCB mount 9, the battery spring terminal PCB mount 10, the battery 11, the battery retainer PCB mounts 12, electronic module base pin 20 (shown in FIG. 6-8), elevation adjuster 21, elevation spring 22, elevation spring set screw 23, the laser 27 (shown in FIGS. 6-8), the laser light housing 28, the laser retaining pin 29 (shown in FIGS. 6-8), the LED 30 (shown in FIGS. 6-8), the LED PCB mount 31 (shown in FIGS. 6-8), the left auxiliary PCB mount 32, the light lens 33, the microcontroller 34, the momentary switch 35, the momentary switch PCB spacer mount 36, PCB mount screw 37, right auxiliary PCB mount 44, solenoid 49, solenoid rod 50, solid battery terminal 51, spring battery terminal 52, windage adjuster 70, windage spring 71, windage spring set screw 72, light momentary switch 76, laser momentary switch 77, and PCB support 78.

Figure 6:
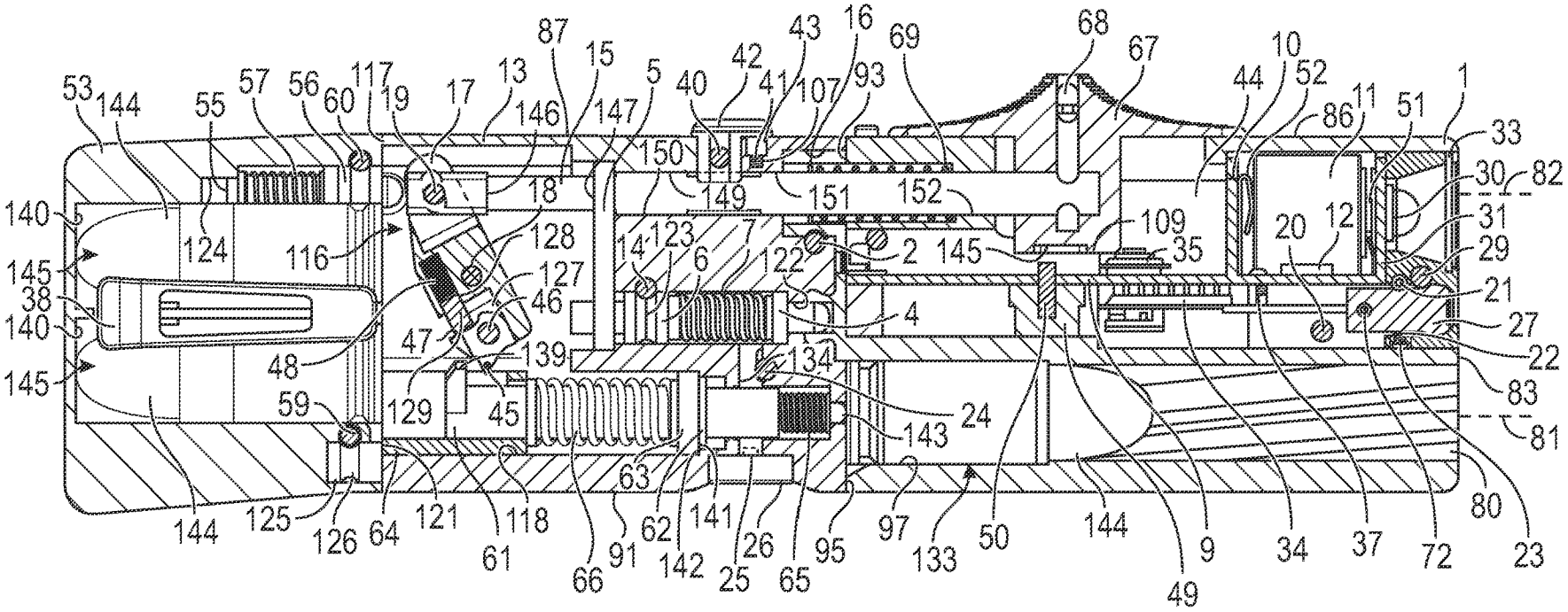
FIG. 6 is a side sectional view of the compact firearm of FIG. 1 in the locked and ready to fire condition with the trigger element in the neutral position.
Figure 7:
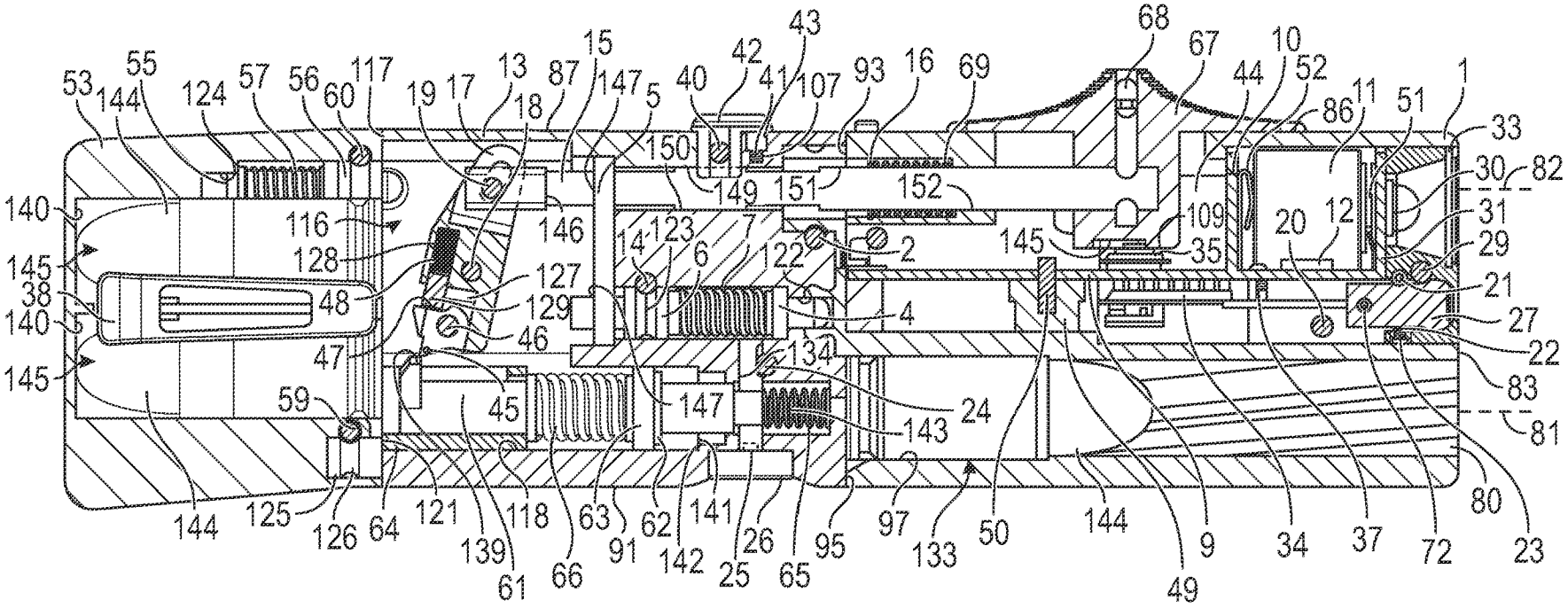
FIG. 7 is a side sectional view of the compact firearm of FIG. 1 in the locked condition with the firing pin drawn back and the trigger element having experienced forward displacement.
Figure 8:
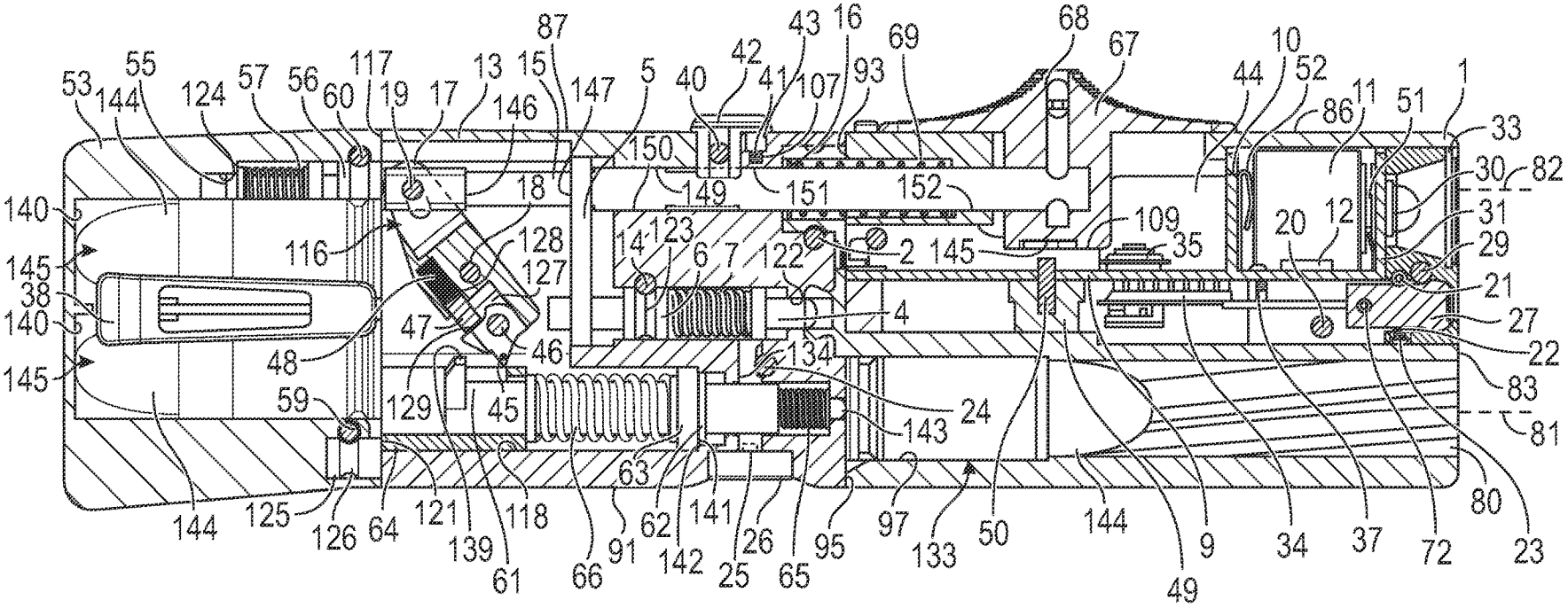
FIG. 8 is a side sectional view of the compact firearm of FIG. 1 in the unlocked condition with the trigger element having experienced rearward displacement.

FIGS. 6-8 illustrate the invention components as they reside in the firearm during a cycle of operation. More particularly, the electronic module 102 is located inside the front 83 of the barrel housing 1 and is coupled to the barrel housing by the electronic module base pin 20. The barrel housing is pivotally connected to the drive housing 13 via their breech lock features (first and second mating features 94, 95) and by the barrel connection base pin 2, which is received in the circumferential groove 104 of the pivot protrusion 103 to axially secure the pivot protrusion within the pivot aperture of the drive housing when the compact firearm is in the open position.

The primary safety spring 41 forces the primary safety switch pin 43 into engagement via the detent features 106 (one of which is visible in FIG. 11B) on the underside of the primary safety switch, which inhibits left/right movement of the primary safety switch. The primary safety spring and the primary safety switch pin are located and guided in the upward/downward directions by a primary safety pin hole 107 defined by the drive housing 13. The primary safety switch is coupled to the drive housing via the primary safety base pin 40. The primary safety switch is also located and guided in the left/right directions by the primary safety base pin, and pitching is prevented by a primary safety switch pocket 108 defined by the top 87 of the drive housing.

The compact firearm 100 can be configured so that the safe position of the primary safety switch 42 allows sufficient forward movement for the trigger element 67 to reach the momentary switch 35 to turn on the function of the flashlight (LED 30) and/or laser 27, while still preventing sufficient forward movement of the trigger element that is required for the sear 45 to contact the striker 61. The momentary switch 35 is internally spring-loaded to be biased to the off condition. The trigger element's lower progressive lobe features 109 enable the actuation of the momentary switch as the trigger element moves in the forward/rearward directions.

The forward end 110 of the drive rod 15 is coupled to the trigger element 67 by the trigger pins 68 engaging with a circumferential groove 111 in the drive rod. The trigger element is prevented from rolling in relation to the barrel housing 1 by a trigger pocket 112 defined by the top 86 of the barrel housing. The rear end 113 of the drive rod is coupled to the drive rod connector 17 by the drive rod connector pin 19 and a slot 114 in the drive rod connector. The drive rod is guided in the forward and rearward directions by an aperture 115 in the pivot protrusion 103 of the barrel housing and surfaces 149, 150, 151, 152 of the drive housing 13. Thus, the drive rod is an elongated rod closely received by respective bores in the first and second frame portions and defining the pivot axis 82, which should not be implied to be concentric with the aperture 84.

The drive rod connector 17 is coupled to the drive rod connector base pin 18, which is coupled to the drive housing 13. This arrangement enables the drive rod connector to pitch pivot about the drive rod connector base pin. The drive rod connector is located in left/right position by a pocket 116 defined by the rear 117 of the drive housing. The sear 45 is coupled to the drive rod connector via the sear connector pin 46, allowing the sear to pitch pivot about the sear connector pin. The drive rod connector is a firing element operably connected to the drive rod 15 and operable to retract and release a firing pin (striker 61).

The striker return spring 65 inhibits forward movement of the striker 61. The striker spring 66 inhibits rearward movement of the striker. The striker is guided in the forward/rearward directions by the striker front bushing 63 and the striker rear bushing 64. The striker front bushing and the striker rear bushing are both located by a striker assembly hole 118 defined by the rear 117 of the drive housing 13. The striker C-ring 62 is seated into a groove 119 defined by the striker, permitting the striker C-ring to move directly with the striker's movements. The striker C-ring also assists in preloading the striker spring by enacting contact with the striker front bushing when the striker moves rearward. The striker C-ring also secures the components of the striker assembly 120 together for ease of disassembly/assembly. The striker rear bushing also assists in preloading the striker spring via contact with a mating surface 121 of the stock 53.

The barrel lock pin 4 is guided in the forward and rearward directions by a barrel lock pin hole 122 defined by the drive housing 13 and by the barrel lock pin retainer bushing 6. The barrel lock pin retainer bushing is coupled to the drive housing via the drive retainer bushing base pin 14. The barrel lock pin is coupled to the barrel lock pin connector 5 by engagement with a rear groove 123 defined by the barrel lock pin, which enables the barrel lock pin and the barrel lock pin connector to move directly together in the forward/rearward directions.

The stock lock pin 55 is guided in the forward and rearward directions by a stock lock pin hole 124 defined by the stock 53 and by the stock lock pin retainer bushing 56. The stock lock pin retainer bushing is coupled to the stock via the stock retainer bushing base pin 60. The stock is coupled axially in the forward/rearward direction to a cylindrical pivot boss 125 protruding from the rear 117 of the drive housing 13 by the stock pivot base pin 59. The stock pivot base pin engages a groove 126 defined by the pivot boss. The stock is able to roll (pivot) about the pivot boss's cylindrical axis.

The sear 45 is located in left/right position by a sear pocket 127 defined by drive rod connector 17. The sear reset pin 47 and sear reset spring 48 are located and guided by a sear pin hole 128 defined by the drive rod connector. The sear reset spring pushes the sear reset pin into a sear pin contact surface 129 on the sear, which inhibits the sear from rotating out of the reset position.

Figure 11A:
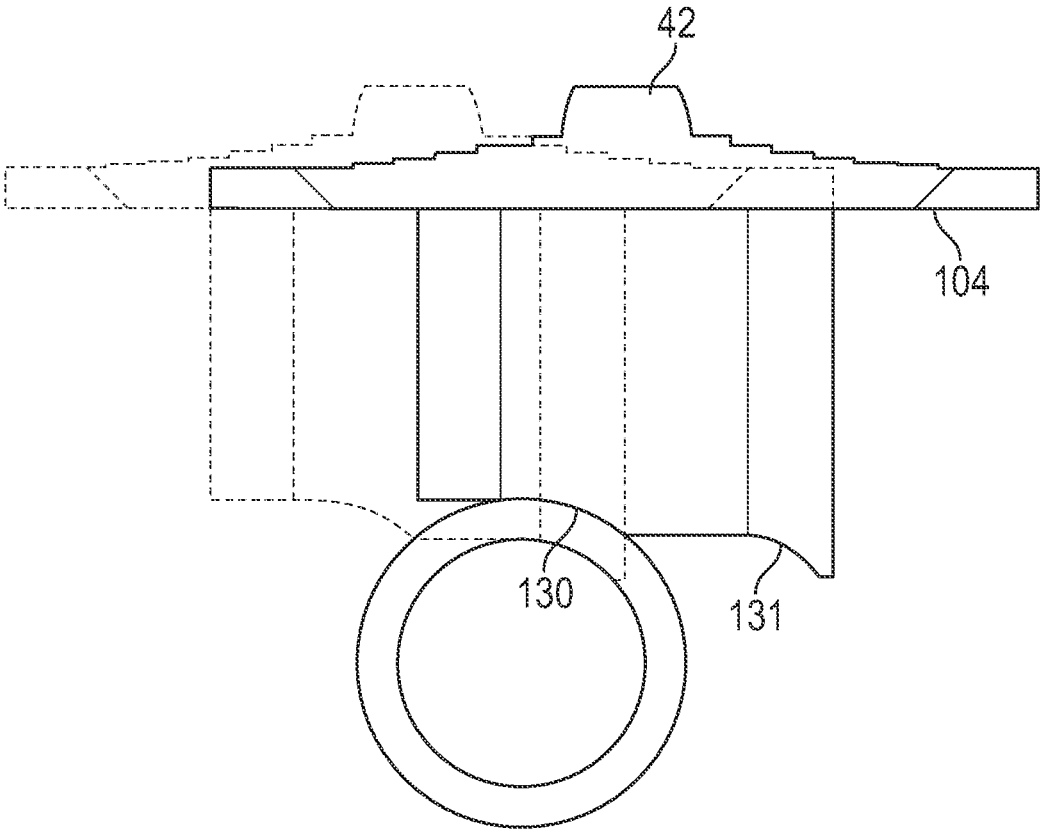
FIG. 11A is a sectional view of the components inside the drive housing of the compact firearm of FIG. 1.
Figure 11B:
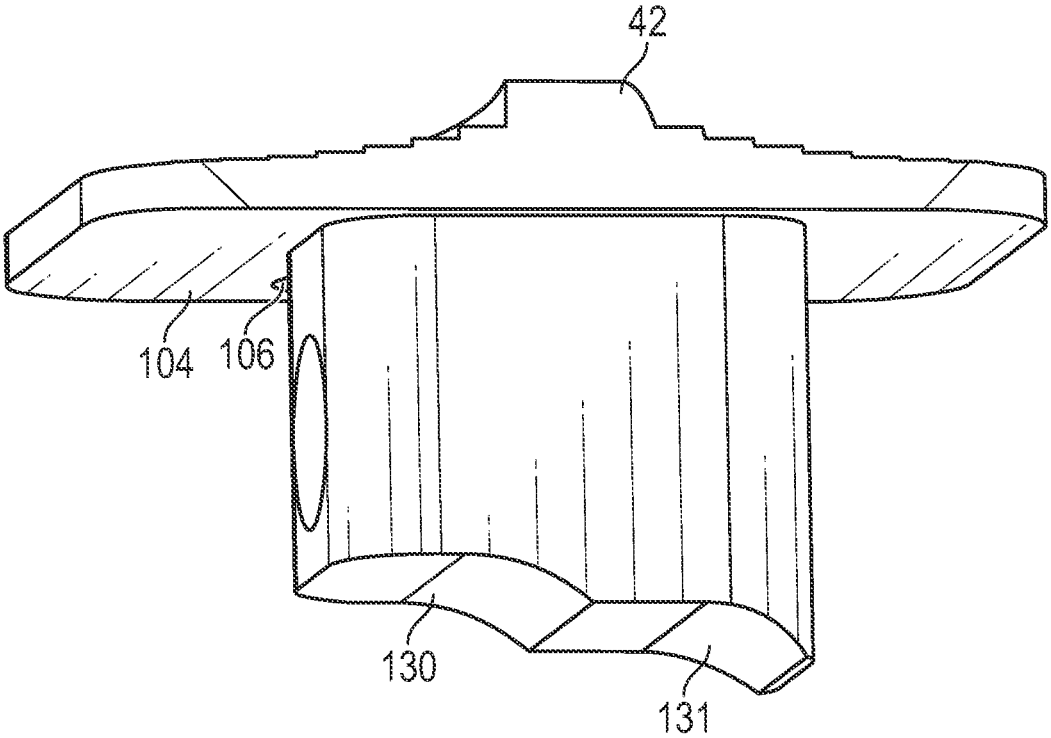
FIG. 11B is a bottom isometric view of the primary safety element of the compact firearm of FIG. 1.
Figure 12A:
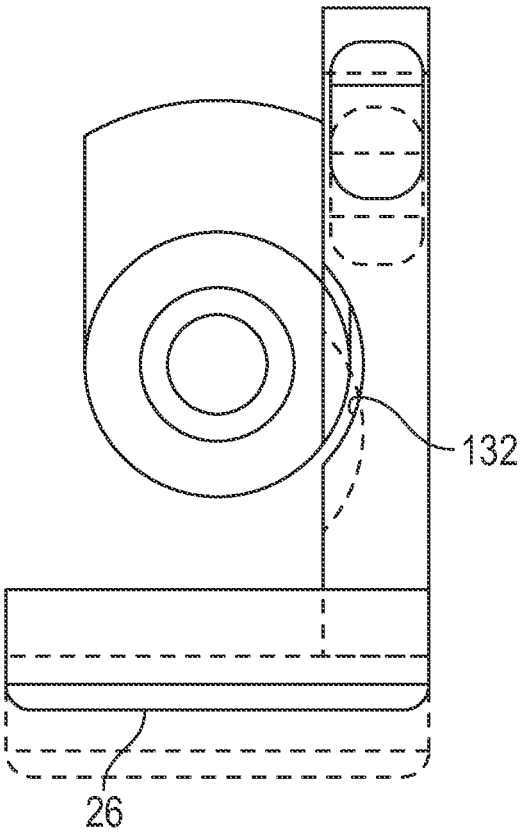
FIG. 12A is a bottom isometric view of the grip drop safety components of the compact firearm of FIG. 1.
Figure 12B:
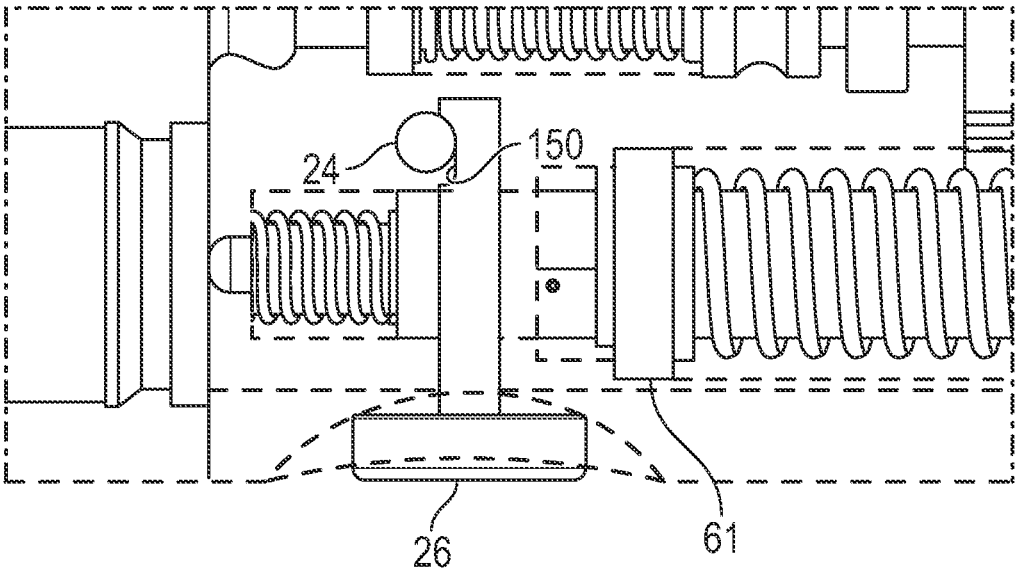
FIG. 12B is a side view of the grip drop safety components of the compact firearm of FIG. 1.

FIG. 6 illustrates the improved compact firearm 100 of the present invention showing the position of key components when the compact firearm is in the ready position. FIGS. 11A & B illustrate the primary safety switch 42 interacting with the drive rod 15 and by itself, respectively. FIGS. 12A & B illustrate the grip drop safety switch 26 interacting with the striker 61. This ready position is the state the compact firearm will be in when being held/gripped by a shooter in the ready-to-fire position. The primary safety switch is in the fire position. When the primary safety switch is in the fire position, lower locking features 130, 131 are moved to the right, which allows forward movements of the drive rod 15 that, in turn, permit the sear 45 to contact/engage the striker 61. The shooter's grip on the invention pushes upward against the grip drop safety spring 25 via the grip drop safety switch to allow a firing position, in which blocking features 132 defined by the grip drop safety switch do not physically block the striker from being able to move forward. The grip drop safety switch is retained vertically by the grip drop safety base pin 24 engaging an upper catch feature 150 defined by the grip drop safety switch. If the invention is configured with an electronic trigger lock, the solenoid rod 50 is retracted downward out of the trigger lock pocket 145 defined by the trigger element 67.

The compact firearm has a neutral position, which is the state the invention will be in when it is holstered, or otherwise not in use. The primary safety switch 42 is in the safe position. When the primary safety switch is in the safe position, lower locking features 130, 131 physically block forward movements of the drive rod 15, which prevents the sear 45 from contacting/engaging the striker 61. The grip drop safety spring 25 forces the grip drop safety switch 26 downward to be in a safe position in which the blocking features 132 on the grip drop safety switch physically block the striker from being able to move forward which, in turn, prevents the strike from being able to make contact with a cartridge 133 in the barrel chamber 97 of the barrel 80. The grip drop safety switch and the grip drop safety spring are located and guided by grip drop safety hole 134 defined by the drive housing 13. If the invention is configured with an electronic trigger lock, the solenoid rod 50 is extended upward into the trigger lock pocket 145 defined by the trigger element 67, which prevents any forward movements of the trigger element that would allow the sear 45 to contact the striker 61.

The barrel lock pin 4 is engaged by a barrel lock hole 135 defined by the first mating feature 94, which prevents the barrel housing 1 from being able to roll (pivot) open. The barrel lock pin spring 7 inhibits rearward motion of the barrel lock pin. A ramp 136 defined by the first mating feature guides the barrel lock pin in the forward/rearward direction when the barrel housing pivots. When the barrel housing 1 is not fully closed, the forward end of the barrel lock pin rides on the ramp, which displaces the barrel lock pin's position rearward of its locked position. This rearward displacement of the barrel lock pin also displaces the barrel lock pin connector 5 because of their direct coupling to each other in the forward/rearward direction. This rearward displacement restricts forward movement of the drive rod 15 via contact between the drive rod surface 146 and the rear face 147 of the barrel lock pin connector. This forward restriction of the firing mechanism prevents the sear 45 from being able to release the striker 61, thereby preventing any potential contact between the striker with any portion of the cartridge 133 that is loaded in the barrel chamber 97, unless the barrel housing is fully closed, which allows the barrel lock pin to move fully forward into the barrel lock hole, hence establishing a breech lock safety functionality.

The stock lock pin 55 is engaged by a stock lock hole 137 defined by the drive housing 13, which prevents the stock 53 from being able to roll (pivot) open. The stock lock pin spring 57 inhibits rearward motion of the stock lock pin. A ramp 138 defined by the drive housing 13 guides the stock lock pin in the forward/rearward direction and into the stock lock hole when the stock pivots.

The sear 45 is in the sear reset position. In this neutral position, the sear is not in contact with a sear tab 139 on the striker 61. The lower switch lobe 109 on the trigger element 67 are not in contact with the momentary switch 35 of the electronic module 102, which means the laser 27 and flashlight (LED 30) are turned off. While in this neutral position, the trigger return spring 69 inhibits forward movement of the firing mechanism 101. The barrel lock pin spring 7 inhibits rearward movement of the trigger element and firing mechanism.

FIG. 7 illustrates the improved compact firearm 100 of the present invention showing the position of key components when the compact firearm is in a forward movement stage of the trigger element 67. The trigger return spring 69 compresses as the trigger element moves forward. In this position, the lower switch lobes 109 on the trigger element are in contact with the momentary switch 35 of the electronic module 102, which means the laser 27 and flashlight (LED 30) are turned on. The compact firearm can also be configured without the momentary switch 35 functionality. The sear 45 contacts the sear tab 139 on the striker 61 and pushes the striker rearwards. Rearward movement of the striker directly moves the striker C-ring 62 rearward, which subsequently moves the striker front bushing 63 rearwards and compresses the striker spring 66. The striker spring reaches maximum compression and maximum potential energy.

Additional forward movement of the trigger element 67 further compresses the trigger return spring 69. In this position, the lower switch lobes 109 on the trigger element are in contact with the momentary switch 35 of the electronic module 102, which means the laser 27 and flashlight (LED 30) are turned on. The sear 45 releases contact with the sear tab 139 on the striker 61, which permits the striker spring 66 to launch the striker, striker C-ring 62, and striker front bushing 63 forward. Forward movement of the striker front bushing stops when the forward surface 141 of the striker front bushing contacts a shoulder 142 defined by the drive housing 13. The striker and striker C-ring continue moving forward, compressing the striker return spring 65, until the forward end 143 of the striker strikes the ammunition primer of the cartridge 133 which, in turn, launches the bullet projectile 144 through the barrel 80. The forward momentum of the launched striker motion easily overcomes the resistance forces of the striker return spring 65. Thus, the firing mechanism is operable in response to forward displacement of the trigger element to operate the firing mechanism to discharge a cartridge.

Initial rearward movement of the trigger element 67 occurs after discharge of the compact firearm 100. In this position, the lower switch lobes 109 on the trigger element are in contact with the momentary switch 35 of the electronic module 102, which means the laser 27 and flashlight (LED 30) are turned on. As the shooter stops applying forward force to the trigger element, the trigger element begins to be driven rearward by the trigger return spring 69 that was compressed during the forward movement of the trigger element. Ramp features on the sear 45 contact the sear tab 139 on the striker 61, causing the sear to begin to pitch (pivot) about the sear connector pin 46 and compress the sear reset spring 48 via contact with the sear reset pin 47, while sliding over the sear tab on the striker.

After additional rearward movement of the trigger element 67, the lower switch lobes 109 on the trigger element are no longer in contact with the momentary switch 35 of the electronic module 102, which means the laser 27 and flashlight (LED 30) are turned off. The trigger element continues to be driven rearward by the trigger return spring 69 until the drive rod 15 is stopped by contact with the barrel lock pin connector's 5 forward face. The ramp features of the sear 45 continue sliding over the sear tab 139 on the striker 61, further compressing the sear reset spring 48.

Once the shooter pushes the trigger element 67 rearward from neutral position, the barrel lock pin spring 7 begins to compress as the drive rod 15 contacts the barrel lock pin connector 5. The ramp features of the sear 45 fully pass the sear tab 139 on the striker 61, allowing the sear to fully reset (pitch/pivot) via the stored energy of the sear reset spring 48 and contact with the sear reset pin 47. The stock lock pin spring 57 begins to compress when the rear flat features defined by the drive rod connector pin 19 contact the forward end features on the stock lock pin 55. The drive rod connector pin's pitch orientation is controlled by a groove defined by the drive housing 13.

FIG. 8 illustrates the improved compact firearm 100 of the present invention showing the position of key components when the invention is in the final rearward movement stage of the trigger element 67. As the shooter continues to press the trigger element rearward, the barrel lock pin spring 7 compresses as the barrel lock pin connector 5 is held securely within the drive housing 13. The stock lock pin spring 57 compresses as rear flat features defined by the drive rod connector pin 19 contact the forward end features defined by the stock lock pin 55. The trigger element can continue to move rearward until the trigger element is stopped by contact with the trigger pocket 112. In this position, the barrel housing 1 and stock 53 can pitch (pivot) open. Thus, the trigger element is operably connected to a lock mechanism operable to selectively prevent and enable relative rotation of the first and second frame elements, and the firing mechanism is operable in response to rearward displacement of the trigger element to enable relative rotation of the first and second frame elements. Furthermore, the third frame portion (stock 53) is rotatable relative to the second frame portion and has a latch element biased to an engaged position in which rotation of the third frame portion is prevented, and a disengaged position in which rotation is enabled. In addition, the first frame portion includes a trigger element operably connected to the firing mechanism, and the latch element of the third frame portion is operably responsive to displacement of the trigger element.

Figure 13:
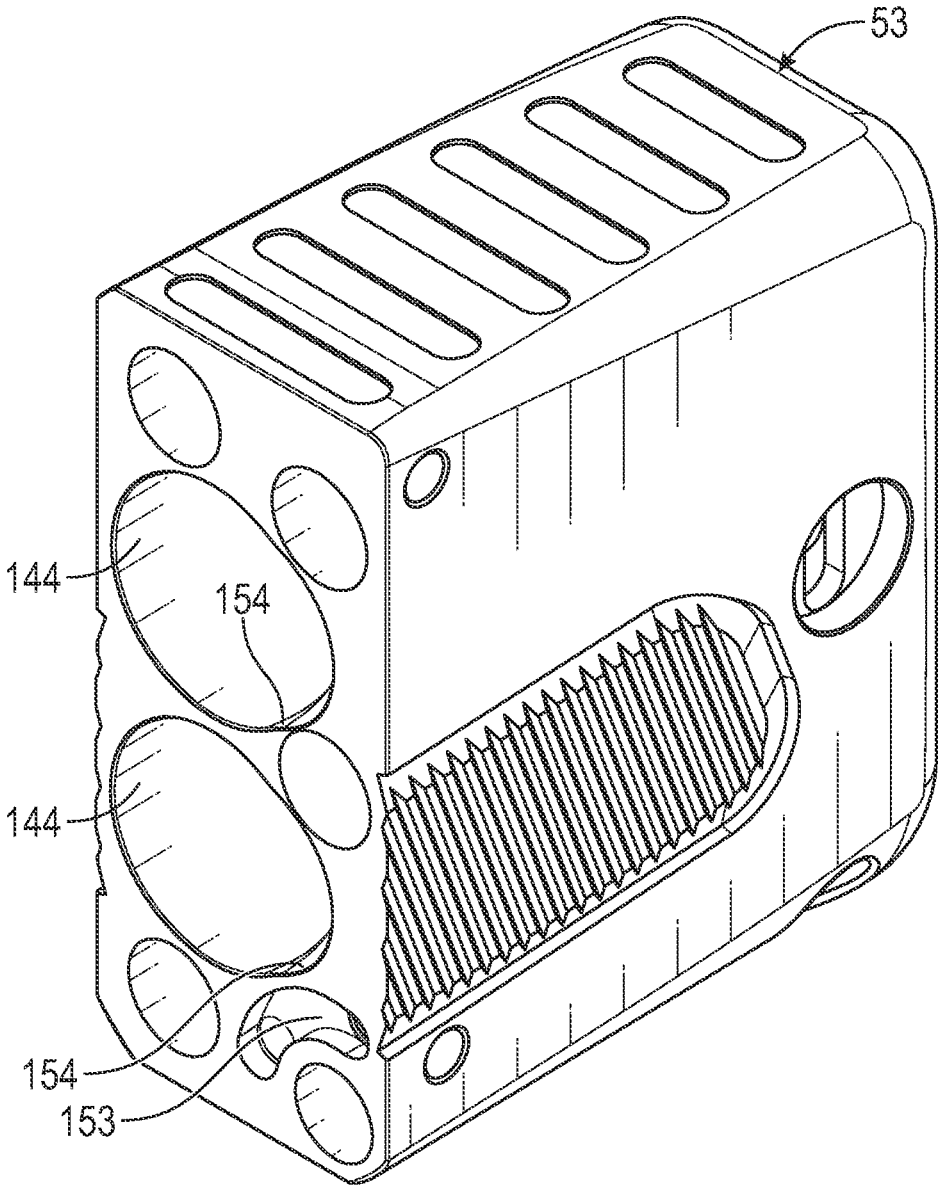
FIG. 13 is a top left isometric view of the left side of the stock of the compact firearm of FIG. 1.

The shooter can release the rearward force on the trigger 67 as soon as the barrel lock pin 4 is rotated past the barrel's 1 barrel lock pin locking features, and the stock lock pin 55 is rotated past the drive's 13 stock lock pin locking features. The detent features assist somewhat in holding the barrel housing and stock in open positions. As the barrel is rotated open, the barrel detent pin 3 follows the barrel's detent pocket features. The barrel detent pin is pushed in the forward direction by the barrel open detent spring 8, which is seated in the drive's barrel open detent hole features. As can be appreciated in FIG. 13, as the stock 53 is rotated open, the stock detent pin 54 follows the stock's detent pocket features 153. The stock detent pin is pushed in the rearward direction by the stock open detent spring 58, which is seated in the drive housing's stock open detent hole features. Once the barrel housing and stock are open, the shooter can access the barrel chamber 97 of the barrel 80 to unload a spent cartridge and to access any cartridges 133 stored in the stock. The compact firearm 100 has a simple loaded chamber indicator via a small sight window cutout 148 at the barrel chamber. To assist with removal of cartridges from the barrel or stock, grooved features 154 are provided that allow a fingernail to catch under the end edge of the cartridge to help lift it out. In the current embodiment, the stock has a capacity of two cartridges stored in cartridge pockets 140.

The optional electronic trigger lock can include a biometric identification device, such as a fingerprint sensor, to be attached to one of the left or right auxiliary PCB mounts 32, 44 of the electronic module 102 to serve as an input to the microcontroller 34 to lock/unlock the trigger element 67. Additional user input options may include using other switches/buttons that could be attached to the left or right auxiliary PCB mounts. Another user input option can be in the form of adding an additional momentary switch that the trigger element can actuate during rearward movements. To use input devices attached to the left/right auxiliary PCB mounts, the barrel housing 1 would be configured with additional pocket features allowing access from the sides of the barrel housing. Similarly, the compact firearm 100 can be configured to allow solar cell mounting to the left/right auxiliary PCB mounts or to the top of the electronic module to provide electrical power or charging to the electronic module.

It should be appreciated that the improved compact firearm 100 of the present invention can be viewed as a frame (barrel housing 1) including a barrel 80 defining a chamber 97. The frame is movable between a closed condition in which the firearm is operable to discharge a cartridge 133 in the chamber, and an open condition in which the chamber is open for loading. A latch (barrel lock pin 4) is movable between a latched condition to retain the frame in the closed condition, and an unlatched condition to enable movement of the frame to the open condition. A firing mechanism 101 is connected to the frame and operable in response to actuation to discharge the cartridge in the chamber. A trigger element 67 is operably connected to the firing mechanism to selectably actuate the firing mechanism, and operably connected to the latch to move the latch to the unlatched condition. The trigger element is operable to selectably actuate the firing mechanism in response to movement in a first direction, and is operable to move the latch to the unlatched condition in response to movement in a different second direction. In the current embodiment, the first direction is opposite the second direction. The barrel defines a forward firing direction, and the first direction is forward, and the second direction is rearward in the current embodiment. The frame includes a forward portion (barrel housing 1) including the barrel, and a rear portion (drive housing 13) containing the firing mechanism. The forward portion and rear portion are pivotally connected to each other. The firing mechanism includes a shaft (drive rod 15) extending from the forward portion to the rear portion. The shaft defines a pivot axis 82 about which the forward portion and rear portion are pivotally connected to each other. A firing pin assembly (striker assembly 120) is received in a bore (striker assembly hole 118) parallel to the shaft (drive rod 15). A sear arm (sear 45) has a first end connected to the shaft, and an opposed second end operably engaged to the firing pin assembly to retract and release the firing pin assembly to discharge the firearm. An additional housing portion (stock 53) rearward of the rear portion and movable between an open and a closed position, with an additional latch (stock lock pin 55) operable to releasably retain the additional housing portion in the latched condition, the shaft being operable to engage the additional latch to release the additional latch. The barrel chamber has a forward limit associated with a case mouth of cartridge 144, and wherein the forward end of the shaft is forward of the case mouth. The trigger element has a protrusion extending away from the frame, the barrel chamber has a forward limit associated with a case mouth, and the protrusion is forward of the case mouth. The frame is an elongated body having opposed major side faces and opposed elongated upper and lower edge faces, the shaft being proximate to one of the upper and lower edge faces, and the barrel being proximate to the other of the upper and lower edge faces. An electronic module 102 is forward of the shaft. The electronic module includes an illuminator (LED 30) projecting a forward beam. A captive dovetail joint (first and second mating features 94, 96) connects the forward and rear frame portions. The term "captive dovetail joint" is intended to encompass both symmetrically and asymmetrically profiled first and second mating features. The forward portion defines a first mating feature 94 formed as a first surface of revolution about the pivot axis 82, the rear portion defines a second mating feature 96 formed as a second surface of revolution about the pivot axis, and the first and second mating features mate closely with each other to minimize or prevent relative forward/rearward movement between the first and second frame portions except in relative rotation about the pivot axis.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a compact firearm has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm comprising:

a frame including a barrel defining a chamber;

the frame being movable between a closed condition in which the firearm is operable to discharge a cartridge in the chamber, and an open condition in which the chamber is open for loading;

a latch movable between a latched condition to retain the frame in the closed condition, and an unlatched condition to enable movement of the frame to the open condition;

a firing mechanism connected to the frame and operable in response to actuation to discharge the cartridge in the chamber; and a trigger element operably connected to the firing mechanism to selectably actuate the firing mechanism, and operably connected to the latch to move the latch to the unlatched condition.

2. The firearm of claim 1 wherein the trigger element is operable to selectably actuate the firing mechanism in response to movement in a first direction, and is operable to move the latch to the unlatched condition in response to movement in a different second direction.

3. The firearm of claim 2 wherein the first direction is opposite the second direction.

4. The firearm of claim 3 wherein the barrel defines a forward firing direction, and wherein the first direction is forward, and the second direction is rearward.

5. The firearm of claim 1 wherein the frame includes a forward portion including the barrel, and a rear portion containing the firing mechanism.

6. The firearm of claim 5 wherein the forward portion and rear portion are pivotally connected to each other.

7. The firearm of claim 5 wherein the firing mechanism includes a shaft extending from the forward portion to the rear portion.

8. The firearm of claim 7 wherein the shaft defines a pivot axis about which the forward portion and rear portion are pivotally connected to each other.

9. The firearm of claim 8 including a firing pin assembly received in a bore parallel to the shaft.

10. The firearm of claim 9 including a sear arm having a first end connected to the shaft, and an opposed second end operably engaged to the firing pin assembly to retract and release the firing pin assembly to discharge the firearm.

11. The firearm of claim 8 wherein the forward portion defining a first mating feature formed as a first surface of revolution about the pivot axis;

the rear portion defining a second mating feature formed as a second surface of revolution about the pivot axis; and the first and second mating features mating closely with each other to prevent relative movement between the first and second frame portions except in relative rotation about the pivot axis.

12. The firearm of claim 7 including an additional housing portion rearward of the rear portion and movable between an open and a closed position, with an additional latch operable to releasably retain the additional housing portion in the latched condition, the shaft being operable to engage the additional latch to release the additional latch.

13. The firearm of claim 7 wherein the barrel chamber has a forward limit associated with a case mouth, and wherein the forward end of the shaft is forward of the case mouth.

14. The firearm of claim 7 wherein the trigger element has a protrusion extending away from the frame, wherein the barrel chamber has a forward limit associated with a case mouth, and wherein the protrusion is forward of the case mouth.

15. The firearm of claim 7 wherein the frame is an elongated body having opposed major side faces and opposed elongated upper and lower edge faces, the shaft being proximate to one of the upper and lower edge faces, and the barrel being proximate to the other of the upper and lower edge faces.

16. The firearm of claim 7 including an electronic module forward of the shaft.

17. The firearm of claim 16 wherein the electronic module includes an illuminator projecting a forward beam.

18. The firearm of claim 5 including a dovetail joint connecting the forward and rear frame portions.

* * * * *